US006665892B1

(12) United States Patent
Crocilla

(10) Patent No.: US 6,665,892 B1
(45) Date of Patent: Dec. 23, 2003

(54) HAIRDRESSING APPARATUS

(75) Inventor: Gaetano Crocilla, Armadale (AU)

(73) Assignee: Agigi Design Pty Ltd., Victoria (AU)

( * ) Notice: Subject to any disclaimer, the term of this patent is extended or adjusted under 35 U.S.C. 154(b) by 0 days.

(21) Appl. No.: 10/088,246

(22) PCT Filed: Sep. 18, 2000

(86) PCT No.: PCT/AU00/01130

§ 371 (c)(1),
(2), (4) Date: Mar. 15, 2002

(87) PCT Pub. No.: WO01/21029

PCT Pub. Date: Mar. 29, 2001

(30) Foreign Application Priority Data

Sep. 17, 1999 (AU) ..... PQ 2926

(51) Int. Cl.[7] ..... A45D 19/08
(52) U.S. Cl. ..... 4/519; 4/515; 4/522; 4/523
(58) Field of Search ..... 4/515, 519, 522, 4/523, 643, 516, 517, 518, 520, 521

(56) References Cited

U.S. PATENT DOCUMENTS 1,855,864 A * 4/1932 Mjaaland et al. ..... 4/644
5,862,542 A * 1/1999 Page ..... 4/523
6,170,096 B1 * 1/2001 Rasmussen ..... 4/519
6,463,597 B2 * 10/2002 Ishimura ..... 4/515

FOREIGN PATENT DOCUMENTS

| | | |
|---|---|---|
| DE | 2109751 | 2/1971 |
| DE | 29618457 | 10/1996 |
| EP | 335206 | 3/1989 |
| EP | 335207 | 3/1989 |
| EP | 776620 | 11/1996 |
| GB | 2160769 | 6/1985 |
| WO | 95/28859 | 11/1995 |
| WO | 99/23907 | 5/1999 |

* cited by examiner

*Primary Examiner*—Gene Mancene
*Assistant Examiner*—Azadeh Kokabi
(74) *Attorney, Agent, or Firm*—Volpe and Koenig, P.C.

(57) ABSTRACT

An apparatus for washing the hair of a person reclining on a chair comprising, a platform (12), a washbasin (10) mounted on the platform having a forward pointing lip (32) to receive the person's head or neck, and translation means (14, 16, 18) for moving the washbasin from a higher position (33) closer to the chair to a lower position more remote from the chair.

12 Claims, 2 Drawing Sheets

HAIRDRESSING APPARATUS

BACKGROUND AND SUMMARY OF THE INVENTION

This invention concerns the mounting and use of basins utilised for washing the hair of clients in hairdressing salons.

There are many types of reclining chairs available which are particularly adapted to use in hairdressing salons. They are used in conjunction with washbasins mounted behind them. The chairs recline to allow the client's hair to be washed and otherwise treated over the basin while minimising entry of water, shampoo and treatment agents onto the face of the client.

A variety of techniques have been employed in attempts to ensure that despite the wide range of sizes of clients, the basin may be correctly and comfortably positioned under the client's head when their chair is reclined. The most common way of providing some adjustment for the client's size is to provide a tilting mechanism for the basin, that is to change its angular orientation fore and aft while maintaining the general position of its bottom where its plumbing is connected.

A more complex arrangement is disclosed in International patent application WO95/28859 and this describes a chair incorporating a basin which, in addition to the tilting facility, may also be moved backwards and forwards relative to the seat in order to better accommodate different sized clients. While this is an improvement over the simple tilt adjustment, some clients can still not be made completely comfortable because either the front wings of the basin are pushing down on the client's shoulders, or the client's neck is being stretched by their head being pushed upwards by the basin, or the client is not leaning far enough back. In particular it can still be difficult to comfortably accommodate clients with longer or shorter than average torsos or with restricted neck movement.

It has now been found that by means of a single mechanism, such a basin can be moved to positions that accommodate the widely different sizes of clients to a better extent than otherwise provided by existing adjustment systems.

Accordingly, the invention provides apparatus for washing the hair of a person reclining on a chair comprising, a platform, a washbasin mounted on the platform having a forward pointing lip to receive the person's head or neck, and translation means for moving the washbasin from a higher position closer to the chair to a lower position more remote from the chair.

In another aspect the invention provides a combination of a recliner chair and a washbasin behind the chair, said chair including a seat and a back support movable between an upright position and a reclining position relative to the seat, and said basin mounted to be movable in a single path which is backwards and downwards away from the seat and forwards and upwards towards the seat.

Preferably the basin maintains its orientation as it moves. The orientation may be separately adjustable. The path may be linear or curved but it is preferably a circular arc.

In a particular embodiment the invention provides apparatus for washing the hair of a person reclining on a chair comprising, a platform, a tilting mechanism mounted on the platform, a washbasin shaped with a deep indentation in the front lip creating two wing portions at the front of the washbasin so that the person's neck may be nested in the indentation, mounted on the tilting mechanism, a stand, four struts forming a four bar linkage, each strut being pivotally mounted to the stand at one position and pivotally mounted to the platform at a second position, the four bar linkage being arranged to permit movement of the washbasin from a higher position closer to the chair to a lower position more remote from the chair, and resilient biasing means for urging the basin to the higher position.

Preferably said path through which the basin moves has a maximum vertical movement in the range of 30 to 80 mm, more preferably 40 to 70 mm, and a maximum horizontal movement in the range of 80 to 300 mm, more preferably 100 to 200 mm.

BRIEF DESCRIPTION OF THE DRAWINGS

In order that the invention may be more fully understood there will now be described, by way of example only, preferred embodiments and other elements of the invention with reference to the accompanying drawings where.

DETAILED DESCRIPTION OF THE PREFERRED EMBODIMENT

Figure 2:
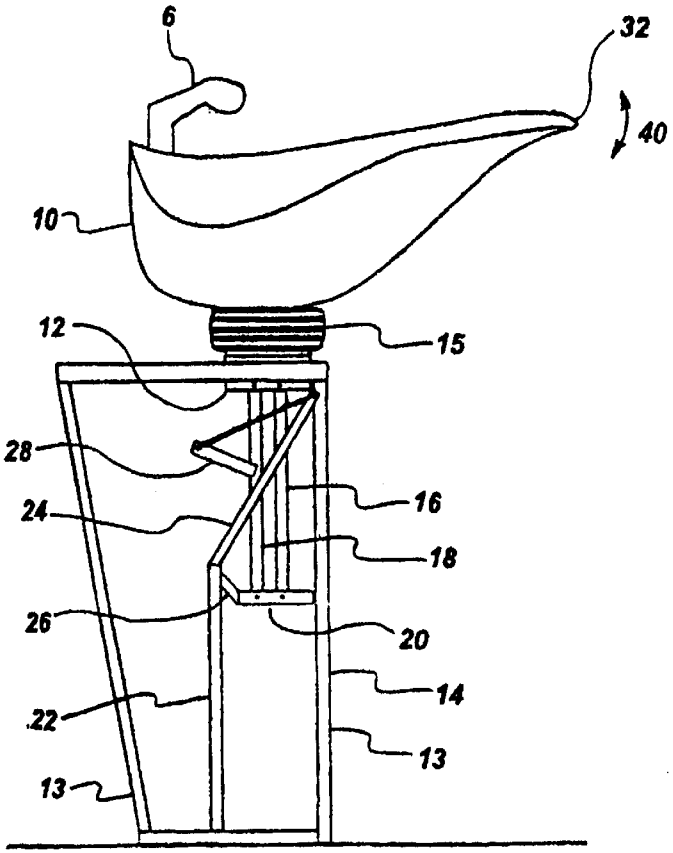
FIG. 2 is a side view of the washbasin and stand of FIG. 1 with the basin in the fully forward position.

Referring to the Figures, a hairdressing washbasin 10 is mounted on a platform 12 supported from within a support stand 14. The support stand 14 has a perimeter frame 13 made from tubular steel with cover panels selected to suit the decor of the salon. A stand 14 is shown with its cover panels removed to expose the working mechanism used to support and adjust the platform 12. The connection 15 between the basin 10 and platform 12 may incorporate a mechanism to allow the basin to tilt forward from its position shown in FIG. 2. Such tilting mechanisms are widely known in the art. They allow the basin to tilt in such a manner as to move the front lip 32 of the basin up or down as shown by the arrow 40. They may incorporate means to lock the basin in a particular orientation once the height of the lip has been adjusted to suit a client.

Figure 1:
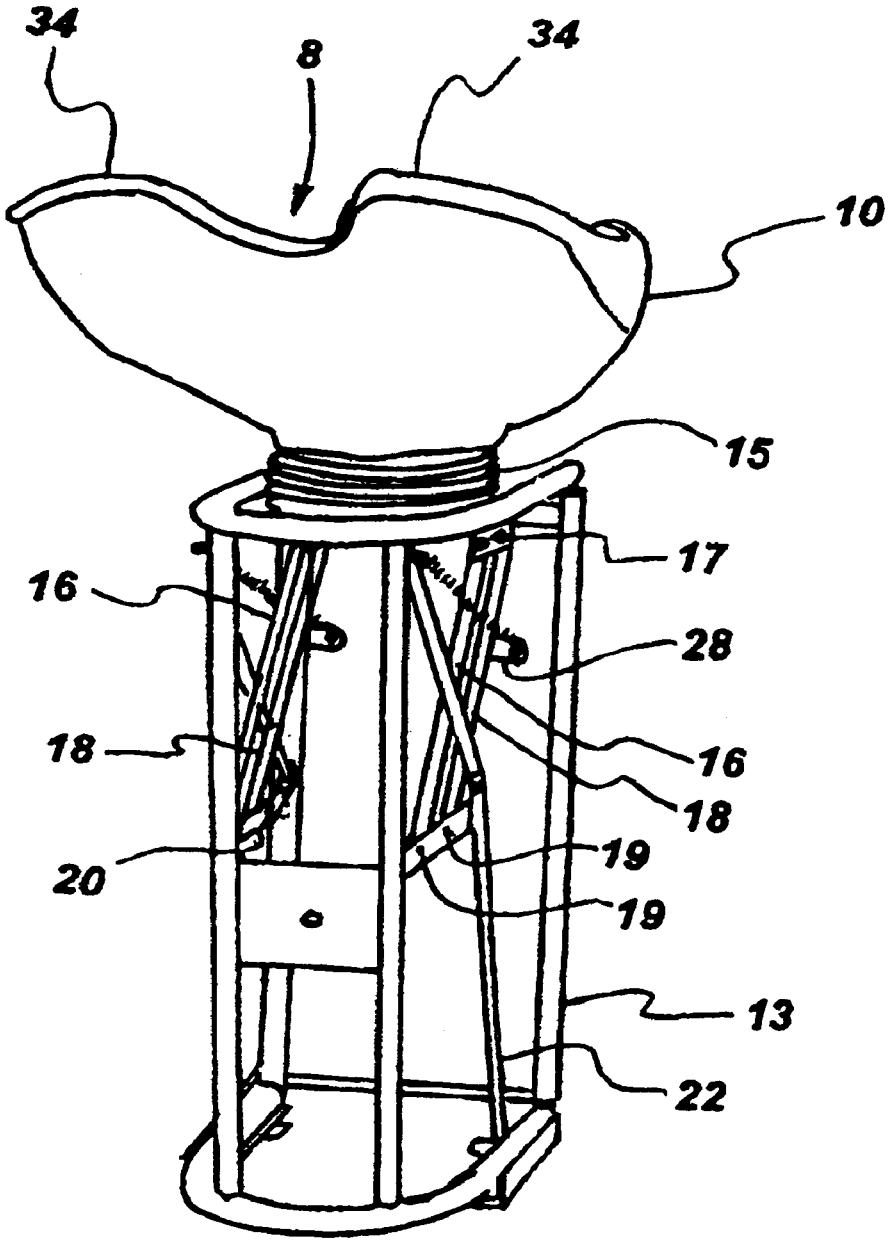
FIG. 1 is a general perspective view of a washbasin on a support stand as used for the present invention with the basin moved to the fully rearwards position.

The basin incorporates all the plumbing fittings required for hot and cold water input plus waste drainage. For clarity of illustration, these piping connections are not shown in the Figures and FIG. 1 omits the tap assembly 6 shown in FIGS. 2 and 3.

The basin 10 is shaped with a deep indentation 8 in the front lip 32 creating two wing portions 34 at the front of the basin so that a client's neck may be nested into the indentation.

Figure 3:
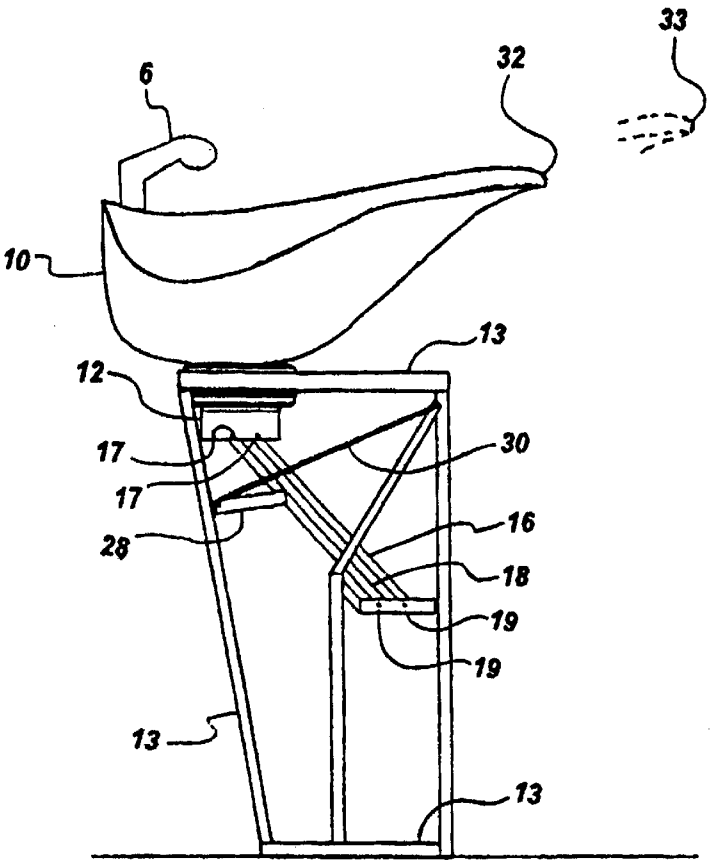
FIG. 3 is a similar view to that of FIG. 2 but with the basin in the position moved fully rearwards as in FIG. 1.

At each side of the stand 14 sub-frame members 22, 24 and 26 rigidly mounted to the frame 13 create a structure to which a pair of support frame members 20 are rigidly attached. A pair of struts 16 and 18 are pivotally connected at one of their ends to each side of the platform 12 and pivotally connected at their other ends to the support frame member 20 at each side of the support stand frame. Each pair of struts 16 and 18, frame member 20 and side of platform 12 form a 4-bar linkage so that as the platform is moved between its two extreme positions shown in FIGS. 2 and 3, the platform 12 moves along a circular arc without the angular orientation of the basin relative to the stand being altered ie. without the basin being tilted. In FIG. 3 the forward most position 33 of the basin is indicated by the dashed lines at the top right of the Figure.

A spring attachment strut 28 is rigidly attached to each of the two struts 18. A coil tension spring 30 extends from the rearmost end of each strut 28 to the top end of sub-frame member 24. This provides a varying degree of lift to the platform 12 which increases as the position of the basin is pushed further rearwards, so compensating for the decreased support available to the platform by way of the compressive forces through struts 16 and 18.

It will be seen that the basin 10 automatically lowers as it is pushed rearwards. It follows a downwardly curving path. As a client sitting in a hairdresser's chair leans backwards as the chair reclines to bring their head over the basin, their head also follows a downwardly curving path. The radii of these two downwardly curving paths are of similar length. The end result is that a greater size range of clients can be more comfortably accommodated while the basin is in use while shampooing or otherwise treating their hair.

In use the front lip 32 of the basin is adjusted to about the nape of the neck of the client. Clients come in a wide range of heights and for the purposes of this invention the important dimension is the distance between the line of the client's hip joints and top vertebra when they are seated. This distance varies considerably and in the situation where the basin may be moved only fore and aft, as in prior art patent specification WO95/28859, there is often a difficult compromise for the angle to which the seat back reclines and the position of the basin which is then comfortable for the client and convenient for the hairdresser. While a basin adjustment system could be arranged such that the basin could be moved vertically as well as horizontally at will, such an arrangement would be unduly expensive to manufacture. The presently proposed obliquely aligned path of motion, which is either straight or more preferably arced, provides significantly improved comfort levels for a wider size range of clients.

In the embodiment shown in the Figures, there is a distance of 340 mm between the pins 17 and 19 which attach the struts 16 and 18 to the platform 12 and the support frame member 20 respectively. This corresponds to the radius of curvature of the path travelled by the platform 12. The radius of curvature is preferably in the range of 250 to 450 mm and more preferably the range of 300 to 400 mm.

In the embodiment shown, the platform 12 is 350 mm above the base of the frame 13 and is in general preferably in the range of 250 to 450 mm. The horizontal distance moved by the platform 12 as it travels the full length of its path is about 170 mm. The vertical distance moved over the path is about 50 mm.

Whilst the above description includes the preferred embodiment of the invention, it is to be understood that many variations, alterations, modifications and/or additions may be introduced into the constructions and arrangements of parts previously described without departing from the essential features or the spirit or ambit of the invention.

For example although the preferred embodiment employs a curved downward motion for the basin as it moves back, the motion could be made linear if desired. But it is important that the basin is lowered as it is moved back from the client.

It will be also understood that where the word "comprise", and variations such as "comprises" and "comprising", are used in this specification, unless the context requires otherwise such use is intended to imply the inclusion of a stated feature or features but is not to be taken as excluding the presence of other feature or features.

What is claimed is:

1. Apparatus for washing the hair of a person reclining on a chair comprising:

a platform, a washbasin mounted on the platform having a forward pointing lip to receive the person's head or neck, and translation means for moving the washbasin along a single arcuate path which extends from a higher position closer to the chair to a lower position more remote from the chair, where as the position of the wash basin is adjusted by moving the washbasin away from the chair to a position suitable for said hair washing, the washbasin is thereby lowered along said arcuate path.

2. Apparatus according to claim 1 wherein the translation means comprise a support stand, and four struts pivotally mounted on the support stand and pivotally connected to the platform, and the struts are associated with resilient biasing means for urging the washbasin towards the higher position.

3. Apparatus according to claim 2 comprising:

four struts forming a four bar linkage with two forward and two rearward struts, a pair of attachment struts one each extending rearwardly from, and at an angle to, a respective said rearward strut, and a pair of spring each secured at a first of its ends to a respective said attachment strut and attached at the other of its ends to a portion of the stand forward of said first end of the spring member.

4. Apparatus according to claim 3 wherein said resilient bias increases as the position of the washbasin is moved further rearwards.

5. Apparatus according to claim 2 wherein the radius of curvature of the arcuate path is in the range of 300 to 400 mm.

6. Apparatus according to claim 1 wherein the platform includes a mechanism for tilting the washbasin relative to the platform to raise or lower the forward pointing lip, and said tilting mechanism incorporates fittings to supply hot or cold water to a tap mounted on the washbasin.

7. Apparatus according to claim 6 wherein the wash basin is shaped with a deep indentation in the front lip creating two wing portions at the front of the washbasin so that the person's neck may be nested into the indentation.

8. Apparatus according to claims 1, 3, 7, 2, 5, 6, or 4, including a recliner chair arranged forward of the lip of the washbasin.

9. Apparatus for washing the hair of a person reclining on a chair comprising, a platform, a tilting mechanism mounted on the platform, a washbasin shaped with a deep indentation in the front lip creating two wing portions at the front of the washbasin so that the person's neck may be nested in the indentation, mounted on the tilting mechanism, a stand, four struts forming a four bar linkage, each strut being pivotally mounted to the stand at one position and pivotally mounted to the platform at a second position, the four bar linkage being arranged to permit movement of the washbasin along a single arcuate path which extends from a higher position closer to the chair to a lower position more remote from the chair, whereby as the position of the washbasin is adjusted by moving the washbasin away from the chair to a position suitable for said hair washing, the washbasin is thereby lowered along said arcuate path, and resilient biasing means for urging the washbasin to the higher position.

10. Apparatus according to claim 9 wherein:

the four struts forming the four bar linkage are positioned such that two are forward and two are rearward within the stand, a pair of attachment struts extend rearwardly from a respective said rearward strut, and extend at an angle to said respective rearward strut, and a pair of spring members are each secured at a first of their ends to a respective said attachment strut and attached at the other of their ends to a respective portion of the stand forward of said first end of the spring member.

11. Apparatus according to claim 10 wherein said resilient bias increases as the position of the washbasin is moved further rearwards.

12. Apparatus according to claim 9 wherein the radius of curvature of the arcuate path is in the range of 300 to 400 mm.

* * * * *